US006458007B1

(12) United States Patent
Verner et al.

(10) Patent No.: US 6,458,007 B1
(45) Date of Patent: Oct. 1, 2002

(54) BALLOON HOLDER

(76) Inventors: Larry Verner, 4361 Plantation Trails, Bellbrook, OH (US) 45305; Rose Verner, 4361 Plantation Trails, Bellbrook, OH (US) 45305

( * ) Notice: Subject to any disclaimer, the term of this patent is extended or adjusted under 35 U.S.C. 154(b) by 0 days.

(21) Appl. No.: 09/838,639

(22) Filed: Apr. 19, 2001

(51) Int. Cl.[7] ..... A63H 3/06

(52) U.S. Cl. ..... 446/220; 40/215; 40/605; 40/617; 248/346.01

(58) Field of Search ..... 446/220; 40/215, 40/214, 610, 736, 605, 617, 124.1; 248/346.01; 206/63.3; 24/18, 129 B, 129 R

(56) References Cited

U.S. PATENT DOCUMENTS

| | | | | | |
|---|---|---|---|---|---|
| 1,680,318 | A | | 8/1928 | Callahan | |
| D180,332 | S | | 5/1957 | Jackson | D49/1 |
| 4,258,843 | A | * | 3/1981 | Wymer | 206/388 |
| D265,863 | S | | 8/1982 | McCarn | D3/23 |
| D273,532 | S | | 4/1984 | Autry | D3/23 |
| 4,879,823 | A | * | 11/1989 | Collins | 40/539 |
| 4,953,713 | A | * | 9/1990 | Yaffe | 206/460 |
| 5,011,447 | A | | 4/1991 | Watanabe | 446/220 |
| 5,024,011 | A | * | 6/1991 | Collins | 211/13.1 |
| 5,036,985 | A | * | 8/1991 | Lovik | 211/13.1 |
| 5,188,314 | A | | 2/1993 | Peters | 244/31 |
| 5,210,911 | A | | 5/1993 | Brown et al. | 24/18 |
| 5,566,821 | A | * | 10/1996 | Brown et al. | 206/388 |
| 5,628,091 | A | | 5/1997 | Mueller | 24/3.2 |
| 5,755,419 | A | * | 5/1998 | Gearhart et al. | 248/176.1 |
| 5,819,448 | A | * | 10/1998 | Kieves et al. | 40/124.06 |

* cited by examiner

*Primary Examiner*—Jacob K. Ackun
*Assistant Examiner*—Bena B. Miller
(74) *Attorney, Agent, or Firm*—Welsh & Katz, Ltd.; Eric D. Cohen

(57) ABSTRACT

A balloon holder for retaining a plurality of balloon strings attached to balloons includes a base portion having a forward end, a back end, and lateral sides. The base has an aperture formed in the base portion while at least one slot is formed in the forward end of the base portion and at least one slot is formed in the back end of the base portion. The aperture is configured to receive the plurality of balloon strings therethrough, and the slots are configured to receive the plurality of balloon strings such that as the plurality of balloon strings are wrapped about the base, the balloon strings are releasably retained by the slots.

10 Claims, 3 Drawing Sheets

BALLOON HOLDER

BACKGROUND OF THE INVENTION

This invention relates generally to a device for holding and tethering balloons. In particular, the present invention relates to a balloon holder for fixing and tethering the strings of a plurality of balloons that are inflated by helium gas so as to permit safe and easy transport of the balloons within a vehicle.

Typically, balloons inflated by helium gas have been sold to customers by inflating a balloon from a gas source and tying the gas inlet of the balloon in a knot, and further tying a string about the knot. The string end of the balloon is then given to the customer. Such helium filled balloons are frequently utilized as decorations at festive events, such as birthday parties, anniversaries, and other celebrations. Often, the balloons are handed to children, who unfortunately, often inadvertently release the strings while carrying the balloons. This results in either loosing the balloons in an outdoor environment or having the balloon trapped by a high ceiling within a dwelling.

Further, balloons are often purchased as a group of four to ten balloons or more in a single bundle. These balloon bundles are usually transported by the customer via automobile or other vehicle. Once placed in the vehicle, the balloons free-float within the vehicle. This poses a safety hazard by blocking the driver's view or by otherwise obstructing the driver's vision through the rear view mirror. Additionally, the free floating balloons can distract the driver and lead to accidents.

Devices for holding and retaining balloons are known. Typically, such devices include a weighted base or platform having an attached loop or ring to which the balloon strings are tethered. Also known are holders having a hollow-body or hemispherical shell having a slot formed therein, such as U.S. Pat. No. 5,755,419 issued to Gearhart et al.

SUMMARY

The disadvantages of present balloon holders are substantially overcome with the present invention by providing a novel balloon holder for retaining a plurality of balloon strings attached to balloons. The balloon holder includes a base portion having a forward end, a back end, and lateral sides. The base portion has an aperture formed in the base portion while at least one slot is formed in the forward end of the base portion and at least one slot is formed in the back end of the base portion. The aperture is configured to receive the plurality of balloon strings therethrough. The slots are configured to receive the plurality of balloon strings such that as the plurality of balloon strings are wrapped about the base, the balloon strings are releasably retained by the slots.

BRIEF DESCRIPTION OF THE DRAWINGS

The features of the present invention which are believed to be novel are set forth with particularity in the appended claims. The invention, together with further objects and advantages thereof, may best be understood by reference to the following description in conjunction with the accompanying drawings.

DETAILED DESCRIPTION

Figure 1:
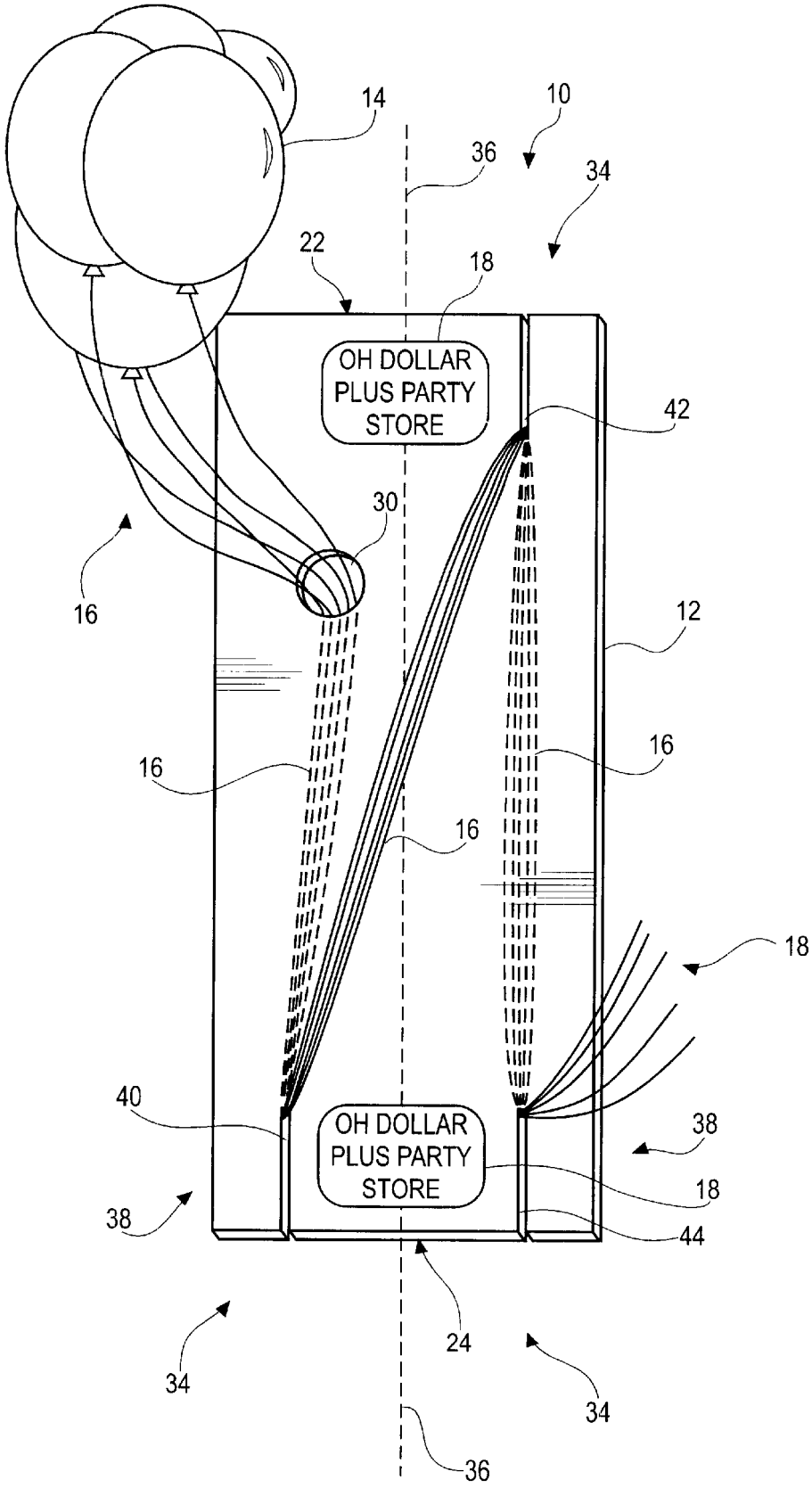
FIG. 1 is a perspective view of a specific embodiment of a balloon holder, according to the present invention.

Referring to FIG. 1, a balloon holder 10 is shown generally. The balloon holder 10 includes a base portion 12. A plurality of balloons 14 (only shown in FIGS. 1 and 2) are secured at one end by string, cord, ribbon or any other conventionally known cordage 16. The loose end of the string is shown as numeral 18.

The base portion or base 12 is formed of a rectangular piece of material of sufficient thickness so as to resist the forces of the helium-filled balloons 14 pulling against the base when one end of the base is fixed. Preferably, the base 12 is made of corrugated cardboard, similar to the material from which standard packing boxes are constructed. Corrugated cardboard has sufficient strength to resist the pull or force exerted, for example by ten helium-filled balloons, affixed to the base 12 via the strings 16 of the balloons 14. The base 12, however, may be formed of any suitable material, such as paperboard, plastic, wood, or metal and the like, which is sufficiently stiff so as to resist the aforementioned forces.

The 12 base is preferable rectangular in shape to facilitate easy and inexpensive fabrication, packaging and distribution. The base may be about four to seven inches in width and about eight to fifteen inches in length. The dimensions of the base 12 are determined by the material used and the number of balloons intended to tether. However, the base 12 need not be in the shape of a rectangle, and any convenient geometric shape may be used for reasons of aesthetics. For example, the base 12 may be a triangle, square, pentagon, hexagon, octagon, and the like, and need not be any specific geometrically defined shape. The base 12 may be formed in any shape, such as a polygon having more than three sides. Alternatively, the base 12 may be irregular in shape having no straight lines. It may also be circular or oblong.

Accordingly, the shape of the base 12 shown in the figures is by way of example only and does not limit the shape of the base to the specific embodiments shown in the figures or described herein. Further, the base 12 need not be planar, but rather, may have undulating or curved surfaces for aesthetic appeal. The base 12 may be capable of being painted or otherwise being formed of material having pigmentation. This facilitates placing advertising 18 thereon, which may be economically advantageous to the vendor supplying the balloons. For example, the vendor may wish to affix the business name or logo 18 to the base to promote his or her business.

The base 12 is thin relative to its length and width, and is preferably about between 1/16 inch to 1/4 inch in thickness. The thickness of the base 12 is dependent upon the material used. Preferably, the base 12 is fabricated from cardboard having a thickness of about 1/8 inch.

Figure 2:
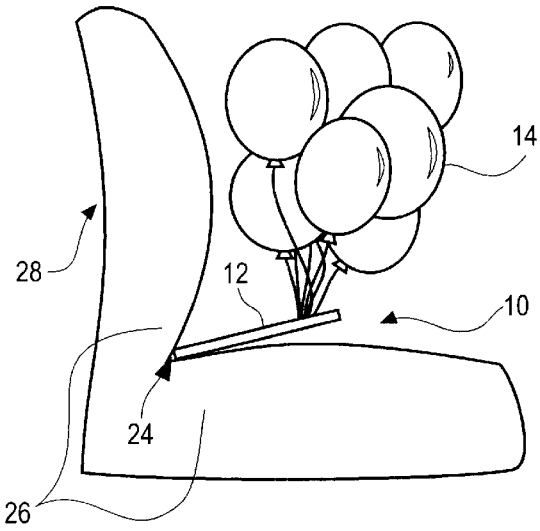
FIG. 2 is an elevational view of the balloon holder of FIG. 1, shown in an operative position.

Referring now to FIGS. 1 and 2, multiple balloons 14 are affixed to the base 12 by the balloon strings 16, as described hereinafter. The balloons 14 tend to float upwardly from the base 12, and are tethered to the base by the balloon strings 16. The position of the balloons 14 when tethered to the base 12 is toward a forward end 22 of the base. A back end 24 of the base 12, opposite the forward end 22, may be inserted or wedged between seat cushions 26 of a vehicle seat 28. For example, the back end 24 of the base 12 may be wedged between the seat cushions 26 of the back seat or front passenger seat of a vehicle. Once wedged in place, the base 12 remains immobile. Accordingly, the balloons 14 affixed to the base 12 cannot move about the vehicle and distract the driver. This may also prevent the balloons 14 from blocking the driver's vision, assuming there are not so many balloons so as to completely block the rear window of the vehicle. Alternatively, the driver of the vehicle may place the base 12 on the front passenger seat and use a weighted object, such as a purse, to hold the base in place on the seat.

In the illustrated embodiment of FIG. 1, an aperture 30 is formed in the base 12. The aperture 30 is about one inch in diameter and may be placed about two inches from the forward end 22 of the base 12 and about one inch from either edge. Placement of the aperture 30 may be at any position toward the forward end 22 of the base 12. The aperture 30 permits the user to easily guide the balloon strings 16 through the aperture to facilitate convenient wrapping of the strings 16 about the base 12, as described in greater detail below.

The base 12 includes multiple slots or channels formed therein, which are identified generally as numeral 34. Preferably, two or more slots 34 or channels are formed in the base 12, which slots extend from an outer edge of the base toward the interior portion of the base. The slots 34 are about one and one-half inches in length. The slots 34 may be single slots, such as cuts formed in the base 12 by a blade-like device, or may define a space where material is removed so as to leave a channel or gap devoid of material. The channel 34 may about one-sixteenth inch wide. The slots 34 are formed in opposite ends of the base 12, with at least one slot formed in the forward end 22 of the base and at least one slot formed in the back end 24 of the base. The slots 34 are generally parallel to a longitudinal axis 36 of the base. Where two slots 34 are formed in one end of the base 12, each of the slots is positioned toward outer lateral sides 38 of the base, as shown toward the back end 24 of the base of FIG. 1. For example, the slots 34 may be located about one inch from the lateral sides 38 of the base 12. However, the slots 34 may be placed at any convenient location at the forward end 22 or the back end 24 of the base 12 so long as the structural integrity of the base is maintained, i.e. the slots should not be formed too close to the lateral sides 38 of the base so as to weaken the base material at that point.

Referring to FIG. 1, in operation, multiple balloons 14 are affixed to the balloon strings 16 by conventional means, such as by a knot. The free ends 18 of the balloon strings are guided through the aperture 30 such that a suitable and convenient length of string remains between the balloons 14 and the aperture. For example, the length of string 16 measured from the aperture 30 to the balloons 14 may be between six inches and twenty-four inches. This distance is dependent upon the number of balloons 14 in the group to be tethered. If only a single balloon 14 is tethered, then a minimal length of string between the aperture 30 and the balloon 14 is needed. If many balloons 14 are tethered, the diameter of the balloons and the space between the balloons dictate the length of the strings required. Of course, the user may adjust this length to suit his or her needs.

After all of the balloon strings 16 have been guided through the aperture 30 and a suitable length of string has been allotted between the aperture and the balloons 14, the user grasps the loose end 18 of the strings. The user then wraps the bundle of strings 16 around the base 12 such that the strings are retained and grasped by a first slot 40 formed in the base opposite the aperture 30. The strings that are not visible in FIG. 1 because they are located on the underside of the base are shown as dashed lines. The user continues to wrap the bundle of strings 16 around the base 12 such that the strings are next retained and grasped by a second slot 42, which is located on the opposite side of the base. The user may optionally secure the bundle of strings 16 such that the strings are retained and grasped by a third slot 44. Of course, the number of wraps or coils about the base 12 depends upon the length of the base and the length of the string 16. If the balloon strings 16 are particularly long, the remainder of the strings may continue to be wrapped about the base 12 between the second slot 42 and either of the first 40 and third slots 44.

Figure 3:
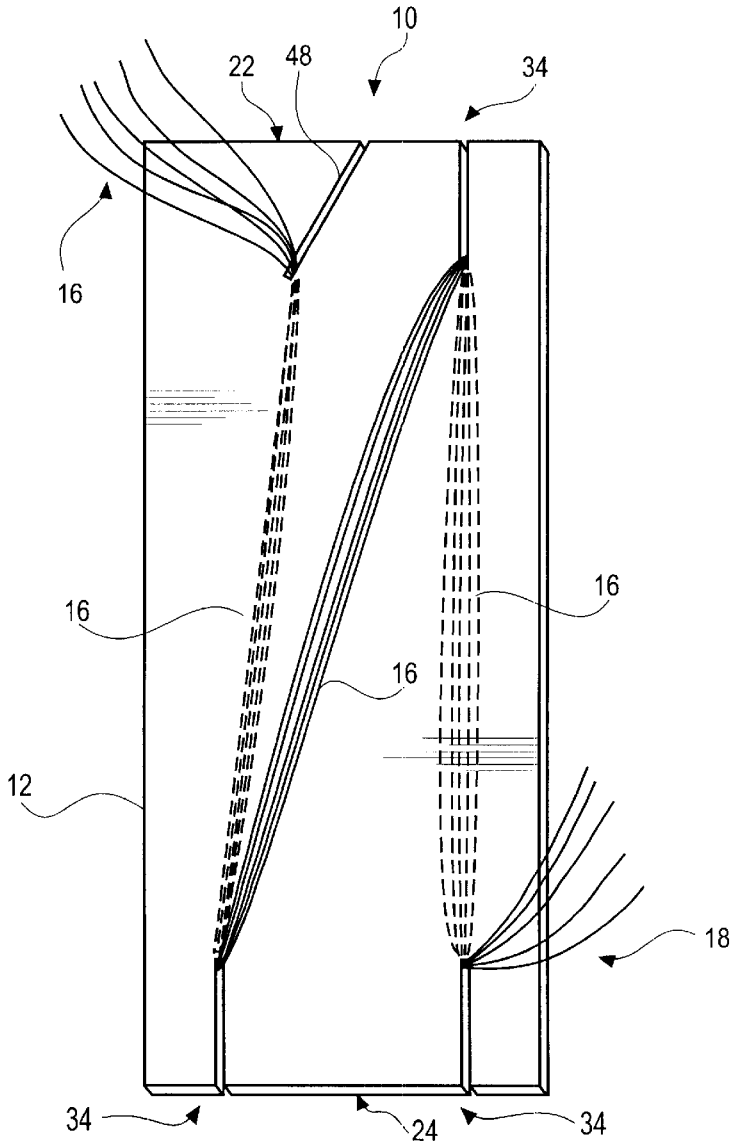
FIG. 3 is an alternate embodiment of the balloon holder.

Many variations with respect to the number and placement of the slots are possible. For example, in an alternate embodiment shown in FIG. 3, the aperture does not exist, but rather, the aperture is replaced with an additional slot 48. This additional slot 48 may be generally diagonal or disposed at about a forty-five degree angle to the other slots 34. In this case, the user determines the length of the string 16 between the balloon and the base, and places or slides the bundle of string in the additional slot 48.

Once the strings 16 have been retained and grasped by the additionally slot 48, the remaining length of string is wrapped around the base 12 and secured by the slots, as described above. Although the additional slot 48 is described as diagonal in the illustrated embodiment, it may also be formed in the base 12 parallel to the other slots 34. In fact, none of the slots 34 need be absolutely parallel to the longitudinal axis 36 (FIG. 1) of the base 12, and may be disposed at an angle. For example, the slots 34 may be disposed at an angle of between zero degrees (parallel) to forty-five degrees (or more) relative to the longitudinal axis 36 (FIG. 1) of the base 12.

Figure 4:
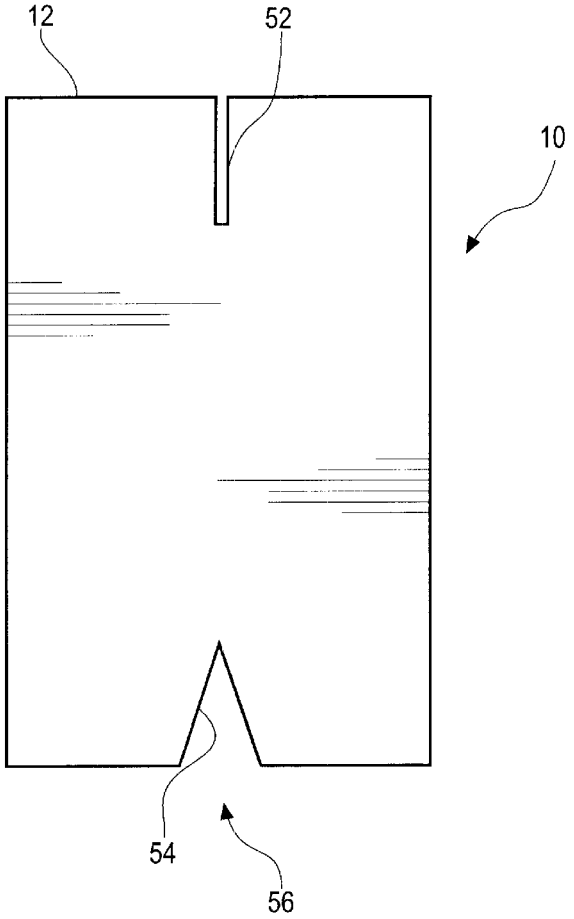
FIG. 4 is an alternate embodiment of the balloon holder.
Figure 5:
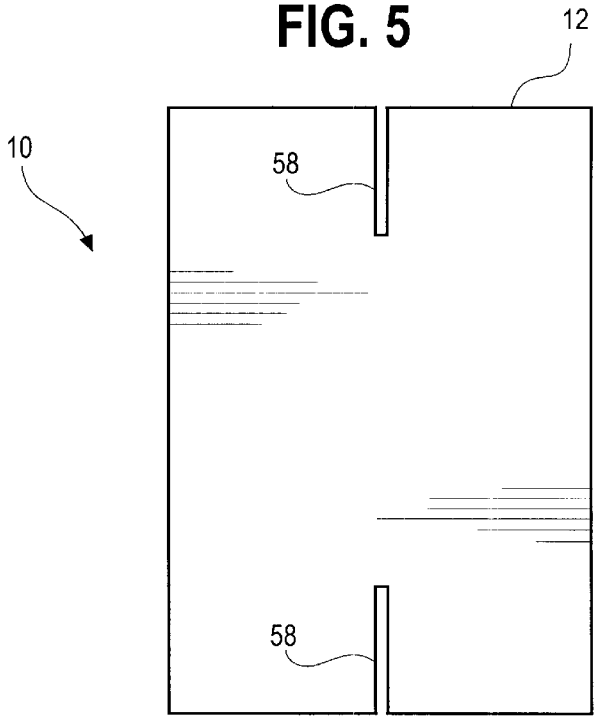
FIG. 5 is an alternate embodiment of the balloon holder.

Alternately, as shown in FIG. 4, the base 12 may include only a single slot 52 of the type described above, but in addition, the base may include a notch or V-shaped groove 54 located opposite the single slot. In this embodiment, the V-shape groove 54 merely fixes the strings (not shown) along a lateral edge 56 of the base 12 while the single slot 52 releasably retains the strings. Alternately, as shown in FIG. 5, the base portion 12 may include only two slots 58 disposed on opposite sides of the base portion.

One advantage of forming the base 12 from cardboard-like material is that cardboard is somewhat "spongy" or pliable, while still retaining its structural integrity. Thus, when the strings are placed in the slot, the material forming the slot walls slightly deforms to create an interference fit between the string and the edges of the slot. Because the string may be removed as easily as it may be inserted into the slot, the slot releasably retains the string. This is particularly advantageous when multiple strings are secured to the base because the slot width need not be adjusted or accounted for during the manufacturing process. A single slot width is used regardless of the number of balloons contemplated to be secured to the base.

Specific embodiments of a balloon holder according to the present invention have been described for the purpose of illustrating the manner in which the invention may be made and used. It should be understood that implementation of other variations and modifications of the invention and its various aspects will be apparent to those skilled in the art, and that the invention is not limited by the specific embodiments described. It is therefore contemplated to cover by the present invention any and all modifications, variations, or equivalents that fall within the true spirit and scope of the basic underlying principles disclosed and claimed herein.

What is claimed is:

1. A balloon holder in combination with at least one balloon for retaining the at least one balloon, the combination comprising:

a base portion having a forward end, a back end, and lateral sides;

an aperture formed in the base portion;

at least one slot formed in the forward end of the base portion, at least one slot formed in the back end of the base portion, at least one balloon string, the at least one balloon string attached to the at least one balloon;

the aperture in the base portion receiving the at least one balloon string therethrough, and having an aperture edge defining a continuous unbroken boundary configured to prevent the from passing into or laterally through the base portion so that the at least one balloon string is retained laterally within the boundary defined by the aperture; and the slots configured to receive the at least one balloon string such that as the at least one balloon string is wrapped about the base, the at least one balloon string is are releasably retained by the slots.

2. The balloon holder of claim 1 wherein the shape of the base portion is selected from the group consisting of a square, rectangle, triangle, pentagon, hexagon, octagon, circle and oblong.

3. The balloon holder of claim 1 wherein the base portion is formed from material selected from the group consisting of cardboard, corrugated cardboard, paperboard, plastic, metal, and wood.

4. The balloon holder of claim 1 wherein the base portion is between four and seven inches in width.

5. The balloon holder of claim 1 wherein the base portion is between eight and fifteen inches in length.

6. The balloon holder of claim 1 wherein the base portion is between one-sixteenth inch and one-quarter inch in thickness.

7. The balloon holder of claim 1 wherein the base portion is formed of material sufficiently pliable such that the slot forms an interference fit when the at least one string are releasably retained therein.

8. The balloon holder of claim 1 wherein the back end of the base portion is configured to be received and retained between adjacent seat cushions of a vehicle seat in a wedging manner.

9. The balloon holder of claim 1 further including at least two slots formed in the back end of the base portion and at least one slot formed in the forward end of the base portion.

10. The balloon holder of claim 1 wherein the at least one slot is a V-shaped notch.

* * * * *